US007080589B2

(12) United States Patent
Beule

(10) Patent No.: US 7,080,589 B2
(45) Date of Patent: Jul. 25, 2006

(54) HYDRAULIC CYLINDER

(75) Inventor: Ulrich Beule, Brilon (DE)

(73) Assignee: BTM Corporation, Marysville, MI (US)

( * ) Notice: Subject to any disclaimer, the term of this patent is extended or adjusted under 35 U.S.C. 154(b) by 0 days.

(21) Appl. No.: 11/041,484

(22) Filed: Jan. 24, 2005

(65) Prior Publication Data

US 2005/0188834 A1 Sep. 1, 2005

Related U.S. Application Data

(63) Continuation of application No. PCT/EP03/07538, filed on Jul. 11, 2003.

(30) Foreign Application Priority Data

Jul. 24, 2002 (DE) ..... 102 33 669

(51) Int. Cl.
*F15B 15/26* (2006.01)

(52) U.S. Cl. ..... 91/422; 91/433; 92/110

(58) Field of Classification Search ..... 91/19, 91/422, 433; 92/110, 183
See application file for complete search history.

(56) References Cited

U.S. PATENT DOCUMENTS

| | | | | |
|---|---|---|---|---|
| 2,858,804 A | | 11/1958 | Banker | |
| 2,969,044 A | * | 1/1961 | Leduc | 91/422 |
| 4,258,609 A | * | 3/1981 | Conway | 91/422 |
| 5,079,997 A | * | 1/1992 | Hong | 92/23 |
| 5,802,953 A | * | 9/1998 | Nakamura | 91/422 |
| 5,918,526 A | * | 7/1999 | Jauhola | 91/246 |

FOREIGN PATENT DOCUMENTS

FR 2 538 047 6/1984

* cited by examiner

*Primary Examiner*—Thomas E. Lazo
(74) *Attorney, Agent, or Firm*—Harness, Dickey & Pierce, P.L.C.

(57) ABSTRACT

The invention relates to a hydraulic cylinder comprising a piston rod bearing at least one tool receiving element. Said hydraulic cylinder is characterized by an automatic disconnection device which is controlled in a hydraulic-mechanical manner, with a medium for the actuation of the hydraulic cylinder. Said medium which is used for building-up force, is also the medium which is used for the automatic disconnection device. Said hydraulic cylinder also comprises a first valve slider and a second valve slider which are used for disconnecting the displacement of a piston, which is connected to a piston rod according to a possible obstruction found in the path of the outward moving piston rod before a desired position by deviating the medium in the region of the piston.

19 Claims, 5 Drawing Sheets

HYDRAULIC CYLINDER

CROSS-REFERENCE TO RELATED APPLICATIONS

This application is a continuation of PCT Ser. No. PCT/EP2003/007538, filed Jul. 11, 2003, which claims priority to German Application No. 102 33 669.5, filed Jul. 24, 2002, both of which are incorporated by reference herein.

BACKGROUND AND SUMMARY OF THE INVENTION

The present invention relates to a hydraulic cylinder having a piston rod bearing a tool-receiving element.

Usually, because of the pressing force required, hydraulic drives having hydraulic cylinders are used for mechanical deforming or joining processes, such as for example punching, stamping, flanging, crimping, riveting or clinching. For safety reasons, when the power stroke of hydraulic cylinders is more than 6 mm, great safety requirements are placed on the systems used. Thus, for avoiding risks, complicated protective curtains and/or mechanical, pneumatic or electrical interlocking devices must be provided. As a result, the operator is very restricted in "handling" work in the dangerous region of the ram of a corresponding deforming or joining device.

Hydraulic cylinder systems which shut off the flow of the hydraulic medium in the hydraulic cylinder by an additional control circuit are well known. Thus, for example, a press is known in which the power stroke is turned on only when an electrically conducting connection is procured through the structural part to be worked via a ram of a tool-receiving element. Here, "finger safety" is secured because of the non-conductivity of the finger or fingers. Additional devices are known in which two electric sensors, working independently of each other, ensure that only a 6-mm power stroke takes place.

Known in addition is a press which uses an internal path-measuring system in order to allow, after calibration, the power stroke to be reduced or first set to 6 mm. Other accomplishments consist for example of a hinged mechanism, covering the region endangering the hands of the operator and only allowing the power stroke when in the folded state. Likewise known is a device with powerless partial thrust, which is characterized in that the drive of the thrust used therein is effected pneumatically and is limited to a total stroke of 60 mm. Another accomplishment consists in avoiding violation of the safety distance of 6 mm by limiting the speed of thrust to a prescribed amount, in order to ensure timely removal/withdrawal of the operator's limbs.

It is the object of the invention to propose a hydraulic cylinder which avoids the complicated and costly precautions known in the prior art as much as possible.

This object is accomplished by a hydraulic cylinder as described herein. By this means, an additional control circuit, be it pneumatic, electrical, mechanical or a combination thereof, advantageously becomes superfluous. The device, with like operating safety, thereby becomes substantially less costly than known systems. Here, the medium (e.g. hydraulic oil) which is used for the development of power is at the same time the medium for the safety shut-off. Other media, such as water or the like, for example, are alternatively usable here. An additional advantage consists in that the device according to the invention is not limited to a total stroke. Theoretically, all desired strokes technically producible can be executed. In addition, the device according to the invention also has the advantage that it is not limited to a maximum speed of movement. The thrust as well as the power stroke speeds are freely selectable with use of the device according to the invention, provided that the technical provisions (existing volumetric flow, feed-line cross sections, etc.) permit this. In addition, with the device according to the invention an internal anti-twisting means advantageously can be integrated with the device according to the invention and via a continuous piston rod an external adjustable full-stroke limitation can be built on, which makes it possible to limit the return stroke of the piston/ram, and hence the full stroke, in any desired position, in simple fashion.

The safety or automatic shut-off means is provided with two valve slides working independently of each other, i.e., upon failure of a component, a forward movement of the ram which might be a danger is no longer possible.

For better understanding of the invention and in order to show how it can be executed, it is described briefly below with reference to an exemplary embodiment.

DETAILED DESCRIPTION

Figure 1A:
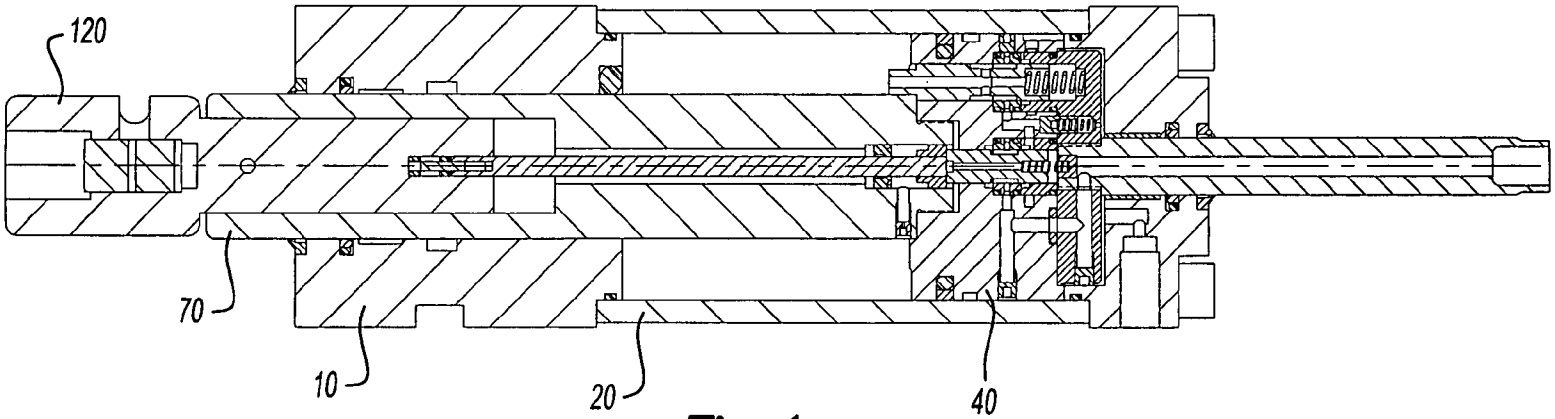
FIG. 1 shows three positions a, b and c of a hydraulic cylinder according to the invention in a variety of working positions.
Figure 1B:
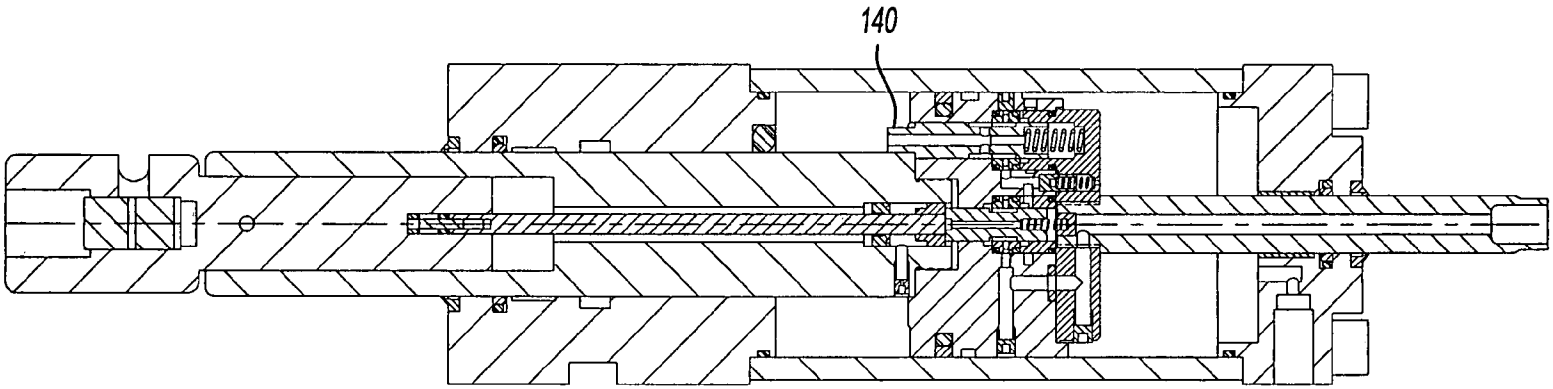
Figure 1C:
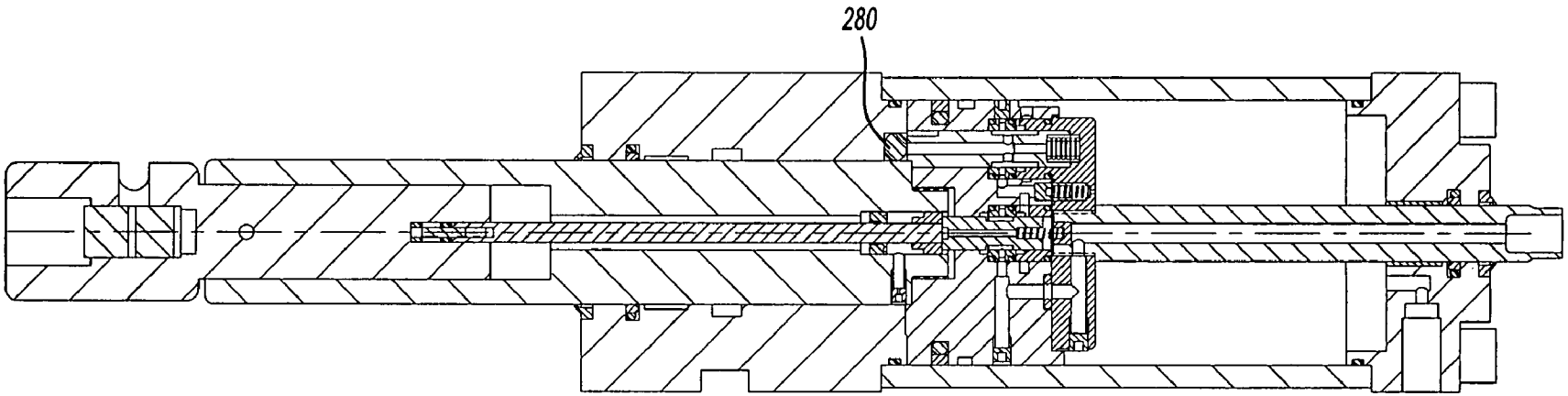

The representations in FIG. 1 show the following working positions: Position a shows the starting position. Position b shows the shut-off position, in which an obstacle in the planned path of travel of the extended piston rod of the cylinder is encountered. Position c shows a hydraulic cylinder with fully extended piston rod after ending the complete power stroke.

The operating routine of the work program of the hydraulic cylinder according to the invention will be described with the aid of the figures. The positions of the components of the hydraulic cylinder according to the invention shown in FIGS. 1*a*, 2*a* and *b* as well as 3 indicate the starting position (position a). Here, a piston 40 is found in the outermost right-hand position in a partially shown cylinder housing 10. The piston 40, to which is assigned a piston rod 70, is axially displaceable in the cylinder housing 10. In the piston rod 70 is located a so-called tool-receiving element 120, which is axially displaceable therein by a small amount. The tool-receiving element 120 is assigned a shut-off rod 130, which in turn can be brought into contact with a first valve slide 100, which is located in the piston 40.

For understanding of the present invention, components which are not absolutely necessary and which nevertheless have reference numerals in the drawing but are of little importance, are not expressly treated, since they can be deduced by those skilled in the art.

In the starting position (position a), the piston 40 is completely retracted. The first valve slide 100 is found in a first position I, in which it holds open a first fluid channel C and closes a second fluid channel D.

Figure 2A:
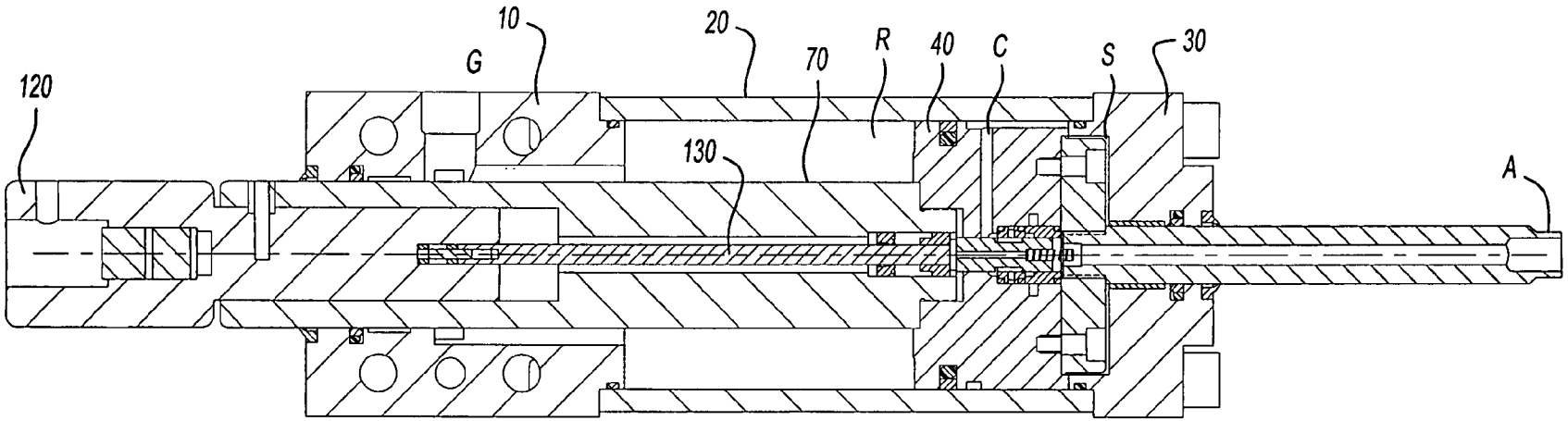
FIG. 2 shows an exemplary embodiment of a hydraulic cylinder according to the invention, where the representation 2*a* shows the cylinder from the side and the representation 2*b* shows the cylinder from above.
Figure 2B:
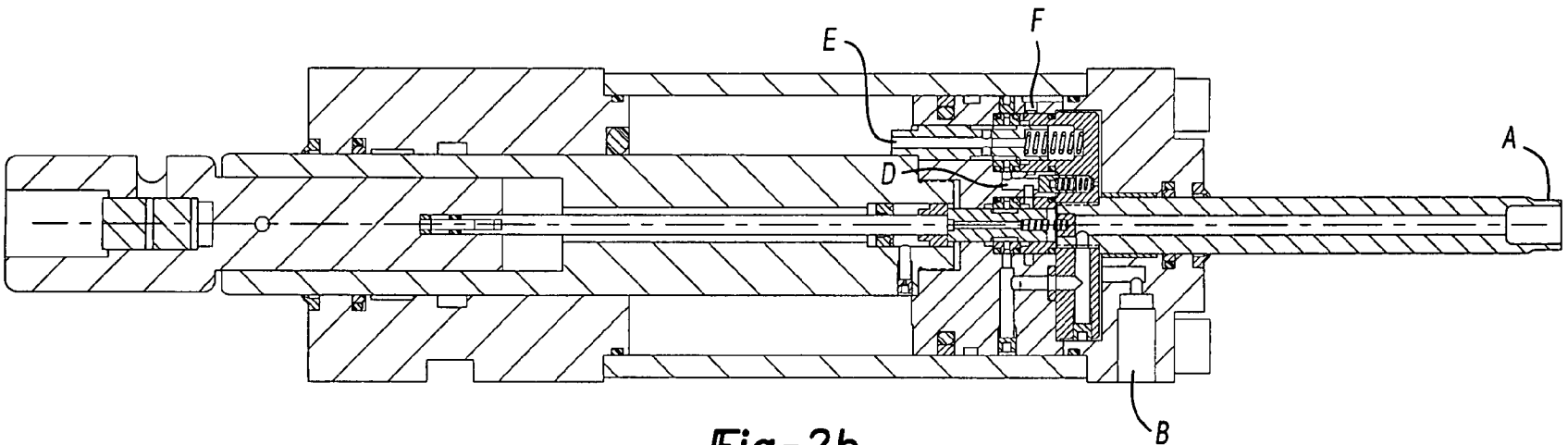

The individual operating steps in the use of the hydraulic cylinder according to the invention are the following:

1. Driving the Cylinder Out:

A main valve, not shown, is opened, so that, via a fluid channel A and the first fluid channel C held open by the valve slide 100, a hydraulic medium can flow into a chamber S (FIG. 3) via the piston 40. The operating medium flows out of a chamber R, found in the interior of the cylinder housing 10, "under the piston" through a fluid line G (FIG. 2*a*).

Figure 4:
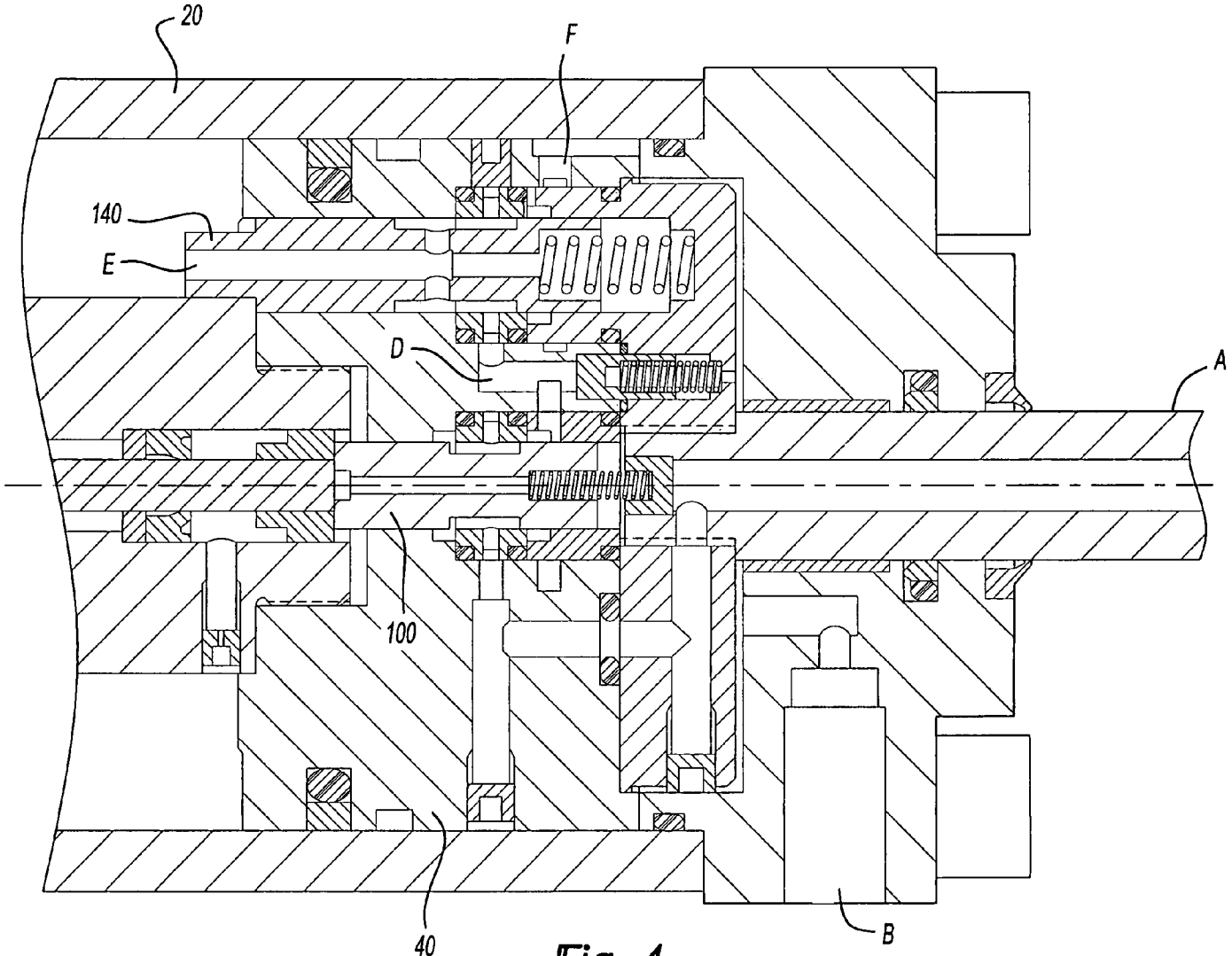
FIG. 4 shows an enlargement of a section of FIG. 2*b*.

2. The Tool-receiving Element 120 Touches Down on an Obstacle More than 7 mm Before the Predetermined Stroke End (Position 1*b*):

The valve slide 100 (FIG. 4) is pushed toward the right by the shut-off rod 130 in FIG. 4. Half way along the path, the fluid channel C is closed by the valve slide 100 and the fluid channel D is opened by the valve slide 100. The hydraulic medium thereupon flows pressureless out of the feed line A via the fluid channels D and E into the chamber R and from there via the line G. The fluid medium in the chamber S is locked in by the piston 40. The result is that the piston 40 stops moving (shut-off function).

3. Return of Piston 40 from Position 1*b:*

The main valve, not shown, is reversed. Flow of the hydraulic medium into the chamber R via the line G (FIG. 2*a*) and flow of the medium out of the chamber S takes place via a check valve, not shown, located in a line B.

4. The Piston 40 Travels into the End Position (Position 1*c*):

In a so-called desired position (e.g. 7.5 mm before stroke end) a second valve slide 140 accommodated in the piston 40 closes down on a sealing means 280 located in the cylinder housing 10. The sealing means selected in this exemplary embodiment is a ball 280.

The third fluid channel E is hereby sealed. At the same time, the connection of the fourth fluid channel F is opened. If the clinching tool, not shown, located in the tool-receiving element 120 is now set up, the valve slide 100 is actuated via the shut-off rod 130 and the first fluid channel C is thereby sealed. But now the hydraulic medium passes on into the chamber S via the lines A, D and F. The piston 40 does not stop, but travels its predetermined stroke to the end, all the way up into the position represented in FIG. 1*c*. The shut-off function of the valve slide 100 hereby ceases due to actuation of the valve slide 140.

5. Retraction of Piston 40 from Position 1*c:*

The main valve, not shown, is again reversed. The medium flows into the chamber R via the line G. The hydraulic medium flows out of the chamber S via a check valve, not shown, located in line B.

Figure 3:
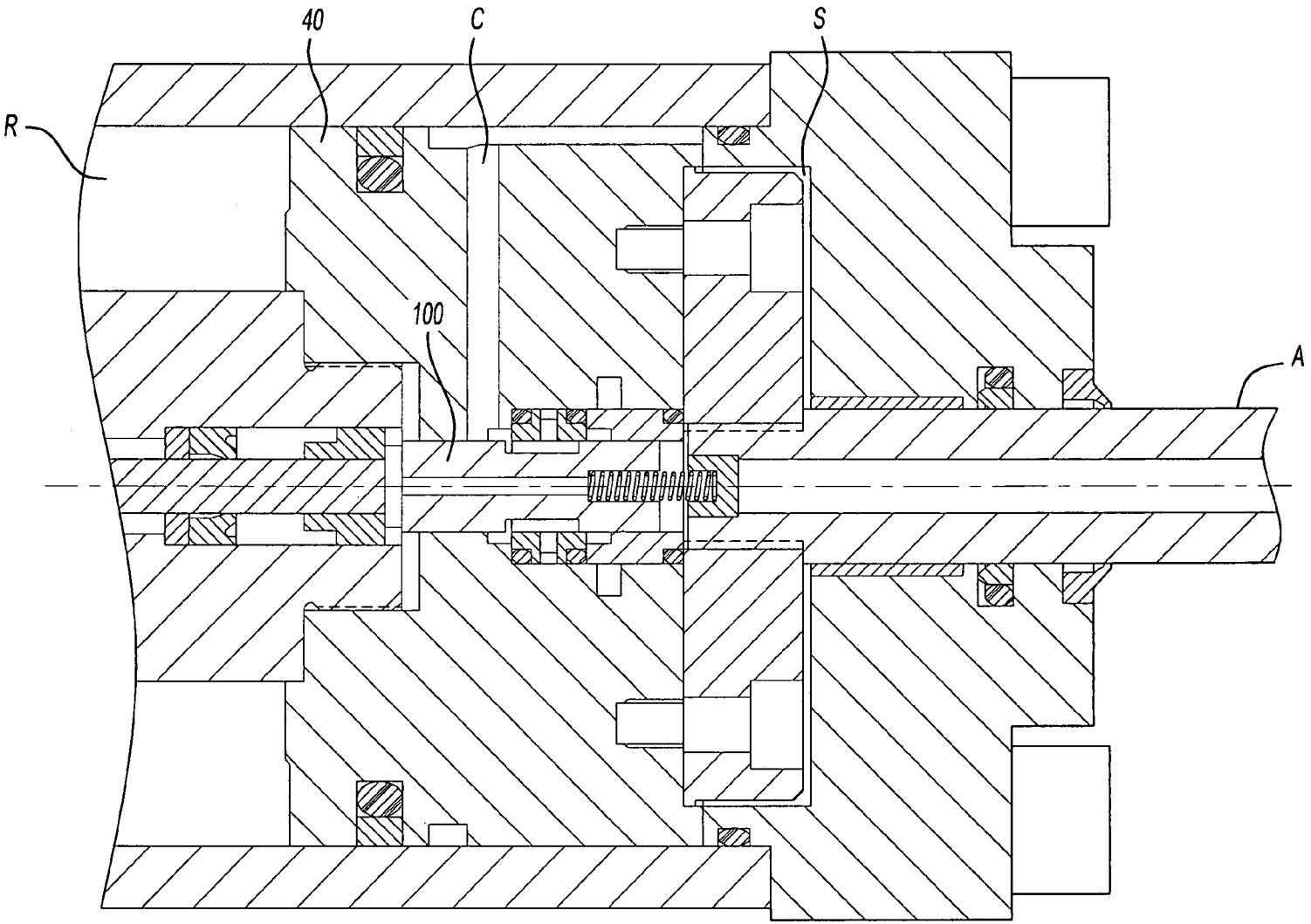
FIG. 3 shows an enlargement of a section of FIG. 2*a*.

6. Resetting of Shut-off Function:

For resetting of the shut-off function of valve slide 100, which has been made ineffective in work step 4, the valve slide 140 must again be shifted into its starting position, shown in FIG. 1*a* and FIG. 3. This is done by the force of a helical spring 390, used here by way of example and shown in FIG. 4, upon return of the piston 40 into its starting position.

The hydraulic line F is hereby sealed again and the third fluid channel E opened again. Should the valve slide 140 now not reach its starting position again, which might be due to malfunction of the spring 390, upon return of the piston 40 the fluid channel E is opened before the line F is sealed. The chamber R is thereby connected with the chamber S. The piston cannot travel back again.

The invention claimed is:

1. A hydraulic cylinder comprising:

a housing;

a piston slidably positioned within the housing and operable to be driven by pressurized fluid between an advanced position and a retracted position;

a ram drivingly coupled to the piston;

a first valve slide slidably positioned within the piston and operable to change the flow of pressurized fluid to restrict the piston from advancing beyond a predetermined position located intermediate the advanced and retracted positions; and a second valve slide slidably positioned within the piston and operable to change the flow of pressurized fluid such that the piston is drivable to the advanced position regardless of the position of the first valve slide.

2. The hydraulic cylinder of claim 1 further including a tool receiving element slidably received by the ram, the tool receiving element being operable to move the first valve slide and restrict advancement of the piston.

3. The hydraulic cylinder of claim 2 further including a rod coupled to the tool receiving element and slidably extending through the ram, the rod being operable to move the first valve slide to a position where advancement of the piston is restricted.

4. The hydraulic cylinder of claim 3 wherein the second valve slide is translatable between a first position and a second position, the second valve slide being located at the second position when the piston is at or advanced beyond a predetermined position.

5. The hydraulic cylinder of claim 4 wherein movement of the piston is not restricted when the second valve slide is at the second position.

6. The hydraulic cylinder of claim 5 wherein the second valve slide is normally biased toward the first position.

7. The hydraulic cylinder of claim 6 wherein the first valve slide is normally biased toward a position allowing advancement of the piston.

8. The hydraulic cylinder of claim 7 further including a supply tube containing the pressurized fluid, the supply tube being mounted to the piston and moveable therewith.

9. A hydraulic cylinder comprising:

a piston rod bearing at least one tool-receiving element; and a hydraulically-mechanically controlled automatic shut-off system including a fluid for operation of the hydraulic cylinder, where the fluid is used for the development of power and, at the same time, for the automatic shut-off system, the automatic shut-off system having a first valve slide and a second valve slide being operable to restrict movement of a piston connected with the piston rod when an obstacle is found in the path of travel of the extending piston rod before advancing beyond a predetermined position by diversion of the fluid in the region of the piston and wherein the first and second valve slides are slidably positioned within cavities formed in the piston.

10. The hydraulic cylinder of claim 9 wherein the tool-receiving element is slidably received by the piston rod.

11. The hydraulic cylinder of claim 10 wherein the tool-receiving element is operable to drive a shut-off rod into contact with the first valve slide and change the path of fluid flow thereby restricting advancement of the piston upon contact of the tool-receiving element with the obstacle.

12. The hydraulic cylinder of claim 11 wherein the second valve slide is operable to re-direct fluid flow and allow the piston to advance when the shut-off rod is in contact with the first valve slide.

13. The hydraulic cylinder of claim 12 wherein the piston includes at least two passageways spaced apart from one another for transferring pressurized fluid.

14. A method of operating a hydraulic cylinder having a piston coupled to a rod, the piston being slidably positioned in a housing, the piston including first and second valve slides, the method comprising:

supplying pressurized fluid to the piston;

moving the piston and the rod in an advancing direction;

contacting an obstacle with the rod;

moving the first valve slide from a first position to a second position to change a fluid flow path and restrict further advancement of the piston and rod.

15. The method of claim 14 further including axially displacing the second valve slide once the piston advances past a predetermined position to allow further advancement of the piston regardless of the position of the first valve slide.

16. The method of claim 15 further including contacting the second valve slide with a seat to discontinue a flow of fluid through the second valve slide.

17. The method of claim 16 further including axially translating a tool receiving element within a bore of the rod and translating a second rod into contact with the first valve slide.

18. The method of claim 17 further including supplying fluid to said housing through a tube mounted for movement with the piston.

19. A hydraulic cylinder comprising:

a housing;

a piston rod slidably positioned within the housing and bearing at least one tool-receiving element; and a hydraulically-mechanically controlled automatic shut-off system including a fluid for operation of the hydraulic cylinder, where the fluid is used for the developement of power and, at the same time, for the automatic shut-off system, the automatic shut-off system having a first valve slide and a second valve slide being positioned within the housing and operable to restrict movement of a piston connected with the piston rod when an obstacle is found in the path of travel of the extending piston rod before advancing beyond a predetermined position by diversion of the fluid in the region of the piston.

* * * * *